US008764329B2

(12) United States Patent
Hasty

(10) Patent No.: US 8,764,329 B2
(45) Date of Patent: Jul. 1, 2014

(54) PIVOTING MECHANICAL APPLICATOR

(75) Inventor: Hugh Hasty, Lewisburg, TN (US)

(73) Assignee: Cosmolab, Inc., Lewisburg, TN (US)

( * ) Notice: Subject to any disclaimer, the term of this patent is extended or adjusted under 35 U.S.C. 154(b) by 501 days.

(21) Appl. No.: 13/178,736

(22) Filed: Jul. 8, 2011

(65) Prior Publication Data

US 2012/0055278 A1 Mar. 8, 2012

Related U.S. Application Data

(60) Provisional application No. 61/363,057, filed on Jul. 9, 2010.

(51) Int. Cl.
*A46B 5/02* (2006.01)

(52) U.S. Cl.
USPC ..... 401/6; 401/86; 401/75; 401/116

(58) Field of Classification Search
CPC ..... A45D 40/02; A45D 40/04; A45D 40/06; A45D 2200/1081; A46B 11/0024; A46B 11/0027; B65D 83/0005; B65D 83/0011; B65D 83/0016; B65D 83/0033
USPC ..... 401/6, 86, 87, 68, 75, 116, 164, 172, 401/173, 174; 222/386, 386.5, 390
See application file for complete search history.

(56) References Cited

U.S. PATENT DOCUMENTS 845,408 A 2/1907 Gohl
1,260,881 A 3/1918 Doty
2,399,660 A 5/1946 Boulicault
3,106,908 A 10/1963 Gretz
3,115,118 A 12/1963 Anderson
3,176,659 A 4/1965 Sauber
3,209,730 A 10/1965 Aston
3,232,276 A 2/1966 Kupersmith
3,739,789 A 6/1973 Cataneo et al.
3,768,915 A 10/1973 Spatz
3,837,749 A 9/1974 Spatz
3,852,884 A * 12/1974 Lazarus ..... 433/141
4,165,755 A 8/1979 Cassai
4,428,388 A 1/1984 Cassai et al.
4,595,124 A 6/1986 Duval
4,687,364 A 8/1987 Kingsford
5,095,580 A 3/1992 Capponi
5,102,248 A 4/1992 Welschoff
5,230,577 A 7/1993 Cox
(Continued)

*Primary Examiner* — David Walczak
(74) *Attorney, Agent, or Firm* — Wilson, Elser, Moskowitz, Edelman & Dicker, LLP.; Jura C. Zibas; Gregory N. Breada

(57) ABSTRACT

An applicator includes a barrel portion, a nose portion, a pivoting joint, a threaded screw, a cup, and a flexible driveshaft. The nose portion is connected to the barrel portion at the pivoting joint. The threaded screw is disposed in the barrel portion and threadably engages a plurality of threads. The cup is disposed in the nose portion and is adapted to carry a mass or instrument. The cup is rotationally fixed to the nose portion and the threaded screw such that rotation of the nose portion relative to the barrel portion causes axial displacement of the cup and the screw relative to the barrel portion. The flexible driveshaft extends between and is rotationally fixed to the threaded screw and the cup. The flexible shaft extends across the pivoting joint disposed at the connection between the nose portion and the barrel portion.

14 Claims, 4 Drawing Sheets

(56) References Cited

U.S. PATENT DOCUMENTS

| | | | | |
|---|---|---|---|---|
| 5,364,197 | A | 11/1994 | Powers | |
| 5,366,311 | A | 11/1994 | Powers | |
| 5,391,011 | A | 2/1995 | Gueret | |
| 5,407,286 | A | 4/1995 | Powers | |
| 5,547,300 | A | 8/1996 | Powers | |
| 5,970,990 | A | 10/1999 | Dunton et al. | |
| 6,026,823 | A | 2/2000 | Gueret | |
| 6,062,753 | A | 5/2000 | Hadtke | |
| 6,149,331 | A | 11/2000 | Raps | |
| 6,412,997 | B2 * | 7/2002 | Berke et al. | 401/6 |
| 6,497,235 | B2 | 12/2002 | Dorsa et al. | |
| 6,530,707 | B1 * | 3/2003 | Byrne et al. | 401/6 |
| 7,823,593 | B2 | 11/2010 | Gueret | |
| 7,951,236 | B2 | 5/2011 | Torrell | |
| 8,235,257 | B2 * | 8/2012 | Avairis | 222/390 |
| 2004/0184865 | A1 | 9/2004 | Carroll | |
| 2006/0137999 | A1 | 6/2006 | Williams | |
| 2007/0079844 | A1 | 4/2007 | Dieudonat | |
| 2010/0147322 | A1 | 6/2010 | Gueret | |

* cited by examiner

PIVOTING MECHANICAL APPLICATOR

FIELD OF THE DISCLOSURE

The present disclosure is generally related to mechanical applicators and, more particularly, to mechanical applicators suitable for use in the hand-held, small scale work.

BACKGROUND

Various types of mechanical type applicators allow the user to propel a mass or instrument out of a tip portion for application. After the mass or instrument is utilized, the user can then retract the mass or instrument back into the applicator to protect it from becoming damaged. Such applicators conventionally include a barrel portion that contains the majority of the mechanical mechanism for propelling and retracting the mass or instrument, and a nose portion from which the mass or instrument is propelled and retracted. It is common for the nose portion and barrel portion to be rotated relative to each other to effectuate propelling and retraction of the mass or instrument. It is also common for such mechanical type applicators to be generally linear in design.

SUMMARY

One aspect of the present disclosure provides an applicator including a barrel portion, a nose portion, a pivoting joint, a threaded screw, a flexible driveshaft, and a cup. The nose portion is connected to the barrel portion. The pivoting joint is disposed at the connection between the nose portion and the barrel portion, and optionally is rotatable along the applicator's axis. The threaded screw is disposed in the barrel portion and threadably engages a plurality of threads carried inside of the barrel portion. The cup is disposed in the nose portion and is adapted to carry a mass or instrument. The cup is rotationally fixed to the nose portion and the threaded screw such that rotation of the nose portion relative to the barrel portion causes axial displacement of the cup and the screw relative to the barrel portion. The flexible driveshaft extends between and is rotationally fixed to the threaded screw and the cup. The flexible shaft extends across the pivoting joint disposed at the connection between the nose portion and the barrel portion.

In one type of embodiment, the pivoting joint can include a ball-and-socket type joint, to effectuate pivoting and rotational translation of the nose portion and barrel portion with respect to each other.

In one type of embodiment, the barrel portion can include a ball while the nose portion comprises a socket retaining at least a portion of the ball to form the rotating and pivoting joint.

In one type of embodiment, the ball-and-socket joint can include a through-bore and the flexible driveshaft can extend through the through-bore.

In one type of embodiment, the through-bore can include a chamfered opening portion to facilitate bending of the flexible driveshaft.

In one type of embodiment, the applicator can further include a one-piece drive member comprising the threaded screw, the cup, and the flexible driveshaft.

In one type of embodiment, the applicator can further include a mass or instrument carried in the cup.

In another aspect, the present disclosure provides an applicator including a barrel portion, a nose portion, a pivoting joint, a screw fitting, and a one-piece drive member. The nose portion is connected to the barrel portion. The pivoting joint is disposed at the connection between the nose portion and the barrel portion. The screw fitting is fixed to the barrel portion in between the barrel portion and the one-piece drive member. The screw fitting engages with the one-piece drive member allowing for axial displacement relative to the barrel portion. The pivoting joint optionally is rotatable along the applicator's axis. The one-piece drive member extends from the barrel portion, through the pivoting joint, and into the nose portion. The one-piece drive member includes a flexible drive shaft extending through a through-bore defined in the pivoting joint. The flexible driveshaft facilitates pivoting of the nose portion and the barrel portion relative to each other.

In one type of embodiment, the one-piece drive member can include a threaded screw, a cup, and the flexible driveshaft. The threaded screw can be disposed in the barrel portion and threadably engage a plurality of threads carried inside of the barrel portion. The cup can be disposed in the nose portion and adapted to carry a mass or instrument. The cup can be rotationally fixed to the nose portion and the threaded screw such that rotation of the nose portion relative to the barrel portion causes axial displacement of the cup and the screw relative to the barrel portion. The flexible driveshaft can extend between and be rotationally fixed to the threaded screw and the cup. The flexible driveshaft can also include a plurality of flexible fins so as provide a seal within the nose portion.

In another embodiment, the threaded screw can include a non-threaded edge at end farthest from the nose portion and joint. This non-threaded edge effects the rotation of the one-piece drive member without axial displacement upon full displacement of the drive member relative to the barrel portion.

In another embodiment, the threaded screw, flexible driveshaft, and cup can be hollow.

In one type of embodiment, the pivoting joint can include a ball-and-socket type joint, to effectuate pivoting and rotational translation of the nose portion and barrel portion with respect to each other. The rotational translation can also effectuate rotation of the mass without axial movement relative to the nose and barrel portions of the applicator.

In one type of embodiment, the nose portion can include a ball and the barrel portion can include a socket retaining at least a portion of the ball to form a rotating and pivoting joint.

In one type of embodiment, the bail-and-socket joint can includes a through-bore and the flexible driveshaft can extend through the through-bore.

In one type of embodiment, the through-bore can be defined in a rotating and pivoting joint and can include a chamfered opening portion to facilitate bending of the flexible driveshaft.

In one type of embodiment, the applicator can further include a mass or instrument carried in the cup.

In one type of embodiment, the threaded screw is rotationally fixed to the barrel portion and configured with a geometry which would allow the screw to be longitudinally looped back on it. The two arms of the looped screw would be secured in channels on opposing sides of the barrel portion.

DETAILED DESCRIPTION

Although the following text sets forth a detailed description of one embodiment of the present disclosure, it should be understood that the legal scope of the disclosure is defined by what a person having ordinary skill in the art would understand is encompassed by the content of this description. The detailed description is to be construed as illustrating an example only and does not describe every possible embodiment of the disclosure or the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this document there is no intent to limit the meaning of that term, either expressly or by implication, beyond its plain or ordinary meaning, and such term should not be interpreted to be limited in scope based on any statement made in any section of this document. To the extent that any term recited in the claims at the end of this document is referred to in the description in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
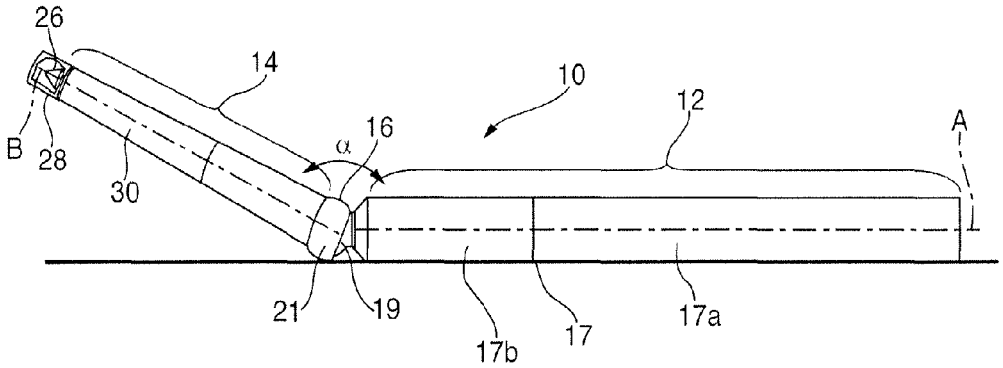
FIG. 1 is a side view of an applicator with a pivoting nosecone in accordance with the present disclosure.
Figure 2:
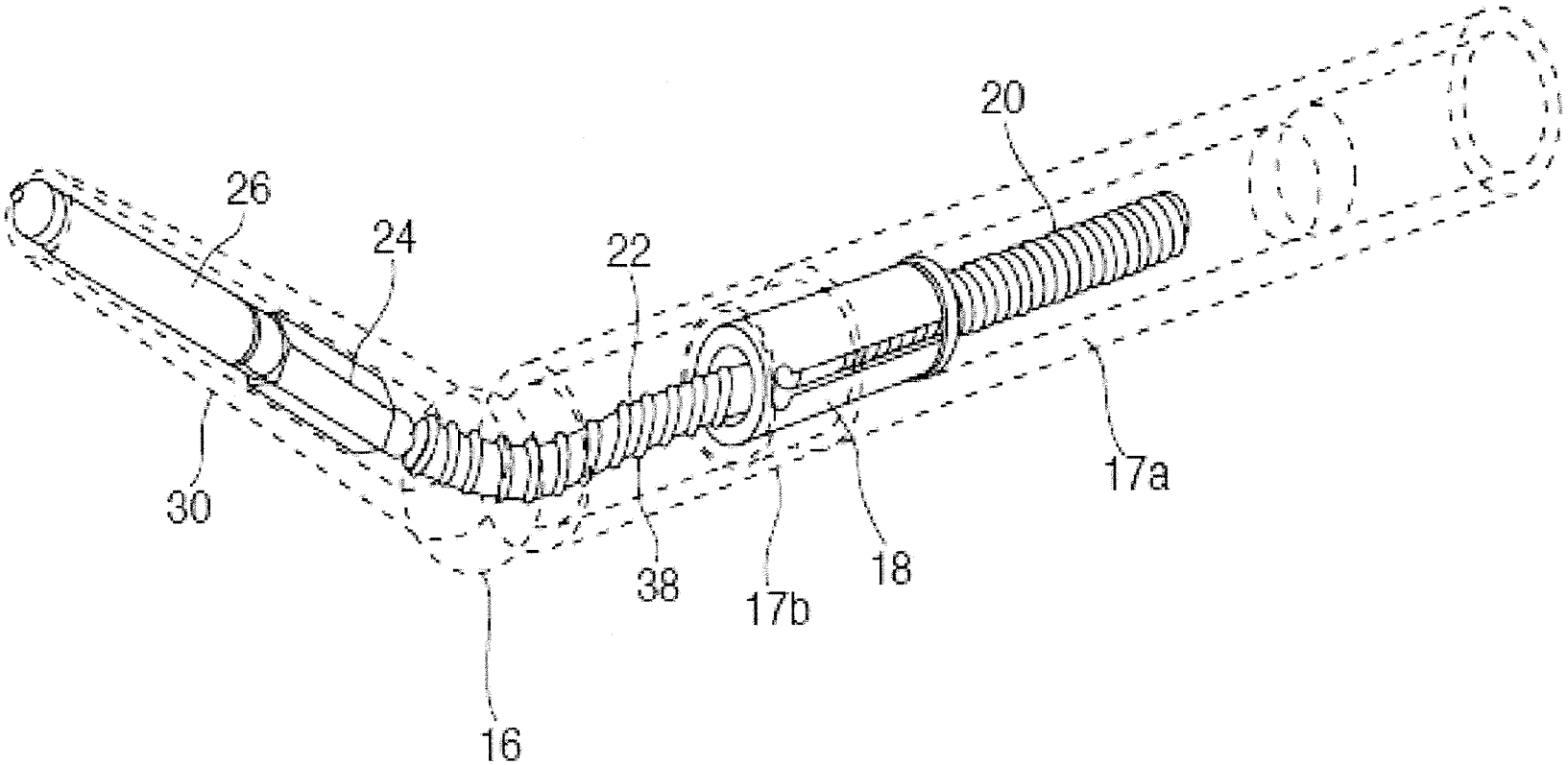
FIG. 2 is a cross-sectional side view of an applicator according to the present disclosure configured as illustrated in FIG. 1.
Figure 2A:
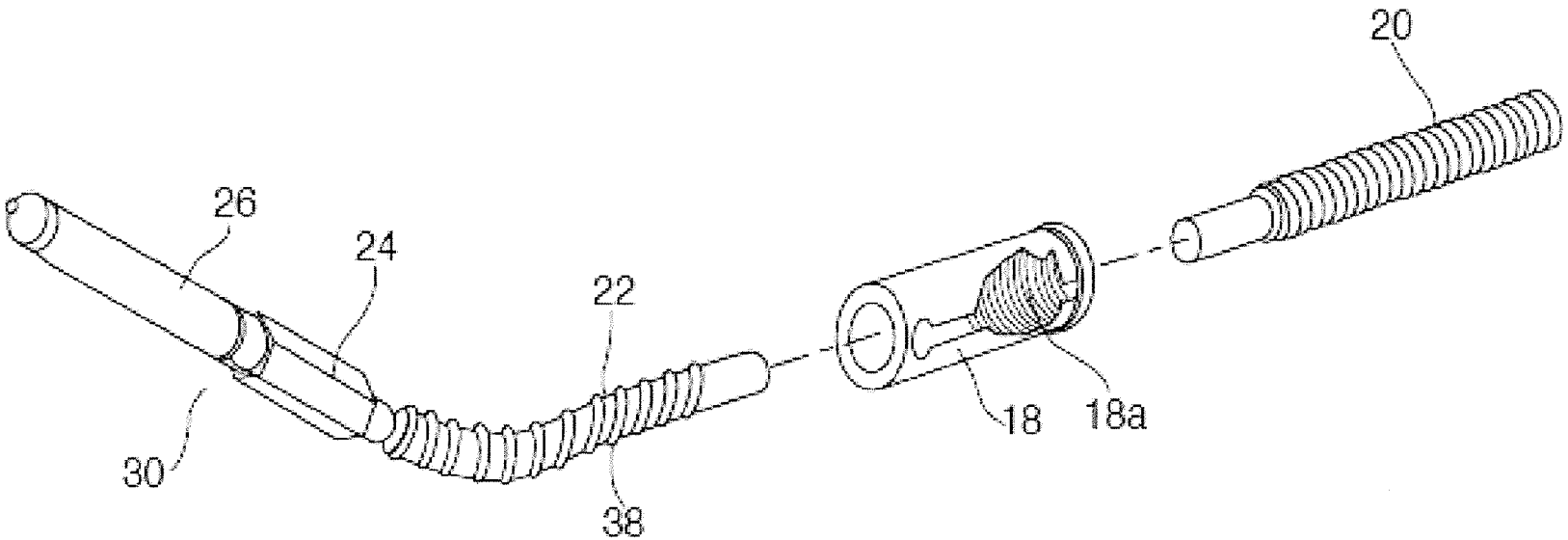
FIG. 2*a* is an exploded view of an applicator according to the present disclosure configured as illustrated in FIG. 1.
Figure 3:
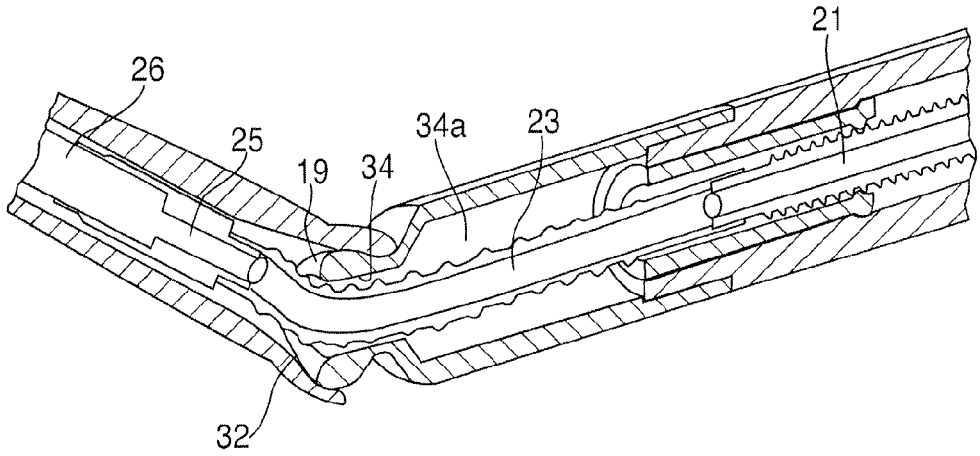
FIG. 3 is a magnified view of the pivot joint section of the applicator according to the present disclosure.

Turning now to FIGS. 1 and 2, the present disclosure provides a device that includes an applicator 10 having a barrel portion 12 and a nose portion 14, from which a mass or instrument may be extended for application and retracted for storage and protection of a tip of a mass or instrument or a marking apparatus. The marking applicator 10 disclosed herein is not limited to use with any specific mass or instrument or marking apparatus. For example, the mass or instrument could a lead pencil, an ink stored in an ink reservoir, a crayon, a chalk, a pen, a needle, a hose, a razor edge, or generally any other type of mass or instrument or apparatus suitable for marking a substrate or surface.

As illustrated, the barrel portion 12 and the nose portion 14 are connected together via a joint 16. The barrel portion 12 includes a central axis A, around which the barrel portion 12 has rotational symmetry. Similarly, the nose portion 14 has a central axis B, around which the nose portion 14 has rotational symmetry. In the disclosed embodiment, the joint 16 includes a ball-and-socket type joint 16. So configured, the nose portion 14 and barrel portion 12 can pivot through an angle relative to each other, as shown in FIG. 2. Such a configuration is advantageous when the marking applicator 10 is used with a mass or instrument because the joint 16 can be utilized to provide a user of the applicator 10 an unobstructed view of his/herself in a mirror during application of the mass or instrument to his/her face, for example. In one embodiment using a mass or instrument, the angle • can be at least thirty degrees (30°) or approximately thirty degrees (30°). In other embodiments with mass or instruments, or any of the other mass or instruments that could be used, the angle • could be generally any angle. In still other embodiments, the nose portion 14 can be pivoted relative to the barrel portion 12 between a number of different positions and locked into place. For example, the nose portion 14 might be pivotable between a straight position extending directly linearly from the barrel portion 12, a first angled position extending at approximately fifteen degrees) (15° from the barrel portion 12, and a second angled position extending at approximately thirty degrees (30°) from the barrel portion 12. In each of the three positions, the nose portion 14 can be locked relative to the barrel portion 12 through the interaction of a circumferential rib (not shown) formed in the socket 21 and one of a plurality of circumferential grooves (not shown) formed on the ball 19. That is, for each specified position of the nose portion 14, the ball 19 could include a groove, in which the rib formed in the socket 21 can reside. In the foregoing embodiment, the ball 19 would include three grooves, one for each position. In other embodiments, the nose portion 14 could be locked relative to the barrel portion 12 in any number of positions and, as such, the ball 19 could include any number of corresponding grooves.

With reference to FIGS. 1 and 2, one working embodiment of the marking applicator 10 of the present disclosure will be described in more detail. As shown, the applicator 10 includes a barrel 17, a screw fitting 18, a screw 20, a flexible driveshaft 22, a cup 24, an optional mass or instrument 26, a sealing cap 28, and a nosecone 30. The barrel 17 includes first and second portions 17*a*, 17*b* fixed together by snap-fit, for example. The second portion 17*b* includes a ball 19 of the ball-and-socket type joint 16. The ball 19 includes a convex partial sphere that defines a through-bore 34. The through-bore 34 includes an opening portion 34*a* that generally increases in diameter away from the remainder of the through-bore 34 such that the opening portion 34*a* is generally chamfered. The screw fitting 18 is disposed inside of the first portion 17*a* of the barrel 17 adjacent the second portion 17*b* and includes an internal threaded portion 18*a* threadably engaging the screw 20. In one embodiment, the screw fitting 18 can be constructed to include a hollow sheath and two flexible arms similar to the device disclosed in commonly owned U.S. Pat. No. 5,547,300, entitled "Cosmetic Pencil with Threads Positioned on Flexible Arms," the entire contents of which are incorporated herein by reference. In other embodiments, the screw fitting 18 could be formed as one piece with the second portion of the barrel 17*b*.

The screw 20, the flexible driveshaft 22, and the cup 24 can be constructed from a single piece of material such as plastic by injection molding, for example, thereby defining a one-piece drive member. Preferably, the one-piece drive member is constructed of a material having a high tensile strength and good rigidity. The geometry of the drive member would allow good flexibility without compromising rigidity requirements along certain portions of the drive member. In alternative embodiments, the screw 20, the flexible driveshaft 22, and the cup 24 can constitute separate components fixed together at their respective ends.

In another embodiment, the screw 20, the flexible driveshaft 22, and the cup 24 can define through-bores 21, 23, and 25 along the applicator's axis. This would allow for storage of additional mass product or instrument within the applicator or for use of the applicator as a guide along its axis for the movement of further mass or instrument unto a substrate or surface.

Still referring to FIGS. 1 and 2, the cup 24 of the disclosed applicator 10 defines a recess that receives an end of the optional mass or instrument 26. The nosecone 30 includes a through-bore 32 and defines a socket 21 of the ball-and-socket type joint 16. The socket 21 includes a concave recess in the shape of a partial sphere that receives at least a portion of the ball 19. The through-bore 32 in the nosecone 30 and the cup 24 include corresponding cross-sections. That is, in the disclosed embodiment, the through-bore 32 in the nosecone 30 has an internal surface with a hexagonal cross-section that corresponds to a hexagonal cross-section of slightly smaller dimension of an external surface of the cup 24. In other embodiments, the cross-sections of the through-bore 32 and the cup 24 could be generally any shape such as to enable to the nosecone 30 and cup 24 to rotate together, as will be described.

The nosecone 30, the cup 24, the mass or instrument 26, the flexible driveshaft 22, and the screw 20 are all rotationally fixed with respect to each other. As mentioned, the socket 21 of the nosecone 30 receives the ball 19 of the second portion 17*b* of the barrel 17 in a manner that allows the ball 19 and socket 21 to rotate and pivot relative to each other. Preferably, the partially spherical socket 21 extends just beyond the great circle (e.g., the equator) of the ball 19 such that a terminal end of the socket 21 retains the ball 19 therein by snap-fit, for example. In optional embodiments, an additional sealing ring or other component can be inserted into the socket 21 and/or around the ball 19 to retain the ball 19 in the socket 21.

The sealing cap 28 is sized and configured to fit over the nosecone 30 and preferably seal against an outer sidewall portion thereof at a location along the nosecone. This preferred seal (not shown) prevents air from entering the sealing cap 28, preventing any air-related damage of optional mass or instrument 26, as is known in the art. In addition to the seal between the sealing cap 28 and the nosecone 30, one embodiment of the flexible driveshaft 22 of the presently disclosed marking applicator 10 can include a plurality of flexible fins 38 just below the cup 24 on the flexible driveshaft 22. The radial fins 38 could include a cross-section that is generally similar to the cross-section of the internal wall of the through-bore 32 (e.g., hexagonal) of the nosecone 30 such that the fins 38 would provide a fluid tight seal between the flexible driveshaft 22 and the nosecone 30. So configured, the fins 38 could prevent air from penetrating the joint 16, thereby working in cooperation with the sealing cap 28 to prevent any damage of the optional mass or instrument 26.

As further shown in FIGS. 1 and 2, the screw 20 resides inside of the barrel portion 12 in threaded engagement with the internal threaded portion 18*a* of the screw fitting 18. The cup 24 and the optional mass or instrument 26 both reside within the through-bore 32 of the nosecone 30. Furthermore, the flexible shaft 22 extends from an end of the screw 20 inside of the barrel portion 12, through the bore 34 in the ball 19 of the ball-and-socket type joint 16, and into the through-bore 32 of the nosecone 30, where it is fixed to the cup 24.

With the applicator 10 constructed as described, a user can propel the mass or instrument 26 out of the nosecone 30, or retract the mass or instrument 26 into the nosecone 30, by rotating the nosecone 30 relative to the barrel portion 12 or vice versa. For example, as a user applies a rotational torque to the nosecone 30, the socket 21 of the nosecone 30 rotates relative to the ball 19 of the second barrel portion 17*b*. The torque applied to the nosecone 30 is transferred through the corresponding internal and external sidewalls of the through-bore 32 and cup 24, respectively, to rotate the cup 24 relative to the barrel portion 12. Rotation of the cup 24 causes the flexible driveshaft 22 and screw 20 to also rotate relative to the barrel portion 12, which causes the screw 20 to rotate relative to the screw fitting 18. Rotation of the screw 20 relative to the screw fitting 18 causes the screw 20 to axially displace relative to the screw fitting 18. Axial displacement of the screw 20, in turn, causes axial displacement of the flexible driveshaft 22, the cup 24, and finally the optional mass or instrument 26. Whether the optional mass or instrument 26 propels from, or retracts into, the nosecone 30 depends on the direction of relative rotation between the nosecone 30 and the barrel portion 12.

While the applicator 10 has thus far been described as including the cup 24, the flexible driveshaft 22, and the screw 20 as being rotationally fixed to the nosecone 30 via the corresponding hexagonal sidewalls, other embodiments can include the cup 24, the flexible drive shaft 22, and the screw 20 rotationally fixed to the first portion 17*a* of the barrel 17. This could be achieved by providing a hexagonal nut, for example, on the screw 20 to correspond with an inner hexagonal surface of the first barrel portion 17*a*. In this embodiment, the nosecone 30 would be rotationally fixed to the screw fitting 18, and the screw fitting 18 would be freely rotatable relative to the first barrel portion 17*a*. As such, rotation of the nosecone 30 would cause rotation of the screw fitting 18 relative to the first barrel portion 17*a* and the screw 20, which in turn would cause the threads 18*a* on the screw fitting 18 to drive the screw 20, the flexible driveshaft 22, the cup 24, and the optional mass or instrument 26 in the axial direction, as desired. In such an embodiment, the through-bore 32 formed in the nosecone 30 would not necessarily have to have a hexagonal cross-section, but rather, it could have a circular in cross-section. This would further enable any flexible fins 38 formed on the flexible driveshaft 22 to also be circular, which could advantageously provide a more consistent fluid tight seal between the fins 38 and the nosecone 30.

Another embodiment can include the cup 24, the flexible drive shaft 22, and the screw 20 rotationally fixed to the first portion 17*a* of the barrel 17 with the screw 20 configured with a geometry which would allow the screw 20 to be longitudinally looped back on itself to provide a significantly shorter finished unit. The two arms of the looped screw would be secured in channels on opposing sides of the barrel 17A. The advantage of this configuration is a significantly shorter finished unit which is easier for the consumer to use and which will allow display of the pencil at Retail in a significantly smaller space.

In view of the foregoing, it should be appreciated that the construction of the device 10 advantageously enables a user to pivot the nose portion 14 and barrel portion 12 relative to each other at the joint 16. Such pivoting is facilitated by the flexible driveshaft 22 extending between the screw 20 and the cup 24 and spanning the joint 16. In this regard, the flexible driveshaft 22 should be flexible enough that it is easy to bend when a user pivots the nose portion 14 relative to the barrel portion 12, but also rigid enough to transfer torque from the cup 24 to the screw 20 during operation of the applicator 10. Thus, the term flexible generally refers to the ability of the driveshaft 22 to bend under the typical pivoting loads applied by a user, and not the ability of the driveshaft 22 to twist in response to the application of torque.

Pivoting of the nose portion 14 is further facilitated by the chamfered opening portion 34*a* of the through-bore 34 in the ball 19 of the joint 16. In the disclosed embodiment, the chamfered opening 34*a* allows the flexible driveshaft 22 to bend in a gradual curve in response to pivoting of the nosecone 30. Such gradual curvature can help increase the useful life of the driveshaft 22. Nevertheless, in alternative embodiments, the through-bore 34 in the ball 19 can be constructed without the chamfered opening portion 34*a*.

While the foregoing has described various embodiments, features, and components of an applicator, the present disclosure is not intended to be limited to the specifics described, but rather is intended to include all logical extensions that a person having ordinary skill in the art would understand is included herein and in the possession of the named inventor(s).

What is claimed:

1. An applicator, comprising:

a barrel portion;

a nose portion connected to the barrel portion;

a pivoting joint disposed at the connection between the nose portion and the barrel portion, said pivoting joint including a through-bore and chamfered opening;

a one-piece drive member extending from the barrel portion, through the pivoting joint, and into the nose portion, the one-piece drive member including;

a threaded screw disposed within the barrel portion;

a cup disposed in the nose portion;

a flexible drive shaft extending through the through-bore defined in the pivoting joint, the flexible driveshaft facilitating pivoting of the nose portion and the barrel portion relative to each other; and wherein the one-piece drive member defines a through bore along its central axis.

2. The applicator of claim 1, wherein the pivoting joint is also a rotating joint.

3. The applicator of claim 2, wherein the rotating and pivoting joint comprises a ball-and-socket type joint.

4. The applicator of claim 1, wherein the cup contains a marking mass or instrument.

5. The applicator of claim 1, wherein the flexible driveshaft contains a plurality of extending fins.

6. An applicator, comprising:

a barrel portion;

a nose portion connected to the barrel portion;

a pivoting joint disposed at the connection between the nose portion and the barrel portion, said pivoting joint including a through-bore and chamfered opening;

a one-piece drive member extending from the barrel portion, through the pivoting joint, and into the nose portion, the one-piece drive member including;

a threaded screw disposed within the barrel portion, a cup disposed in the nose portion;

a flexible drive shaft extending through the through-bore defined in the pivoting joint, the flexible driveshaft facilitating pivoting of the nose portion and the barrel portion relative to each other; and wherein the one-piece drive member is rotationally fixed to the nose portion such that rotation of the nose portion relative to the barrel portion causes axial displacement of the cup and the screw relative to the barrel portion.

7. An applicator, comprising:

a barrel portion;

a nose portion connected to the barrel portion;

a pivoting joint disposed at the connection between the nose portion and the barrel portion;

a threaded screw disposed in the barrel portion and threadably engaging a plurality of threads carried inside of the barrel portion;

a cup disposed in the nose portion and adapted to carry a mass or instrument, the cup rotationally fixed to the nose portion and the threaded screw such that rotation of the nose portion relative to the barrel portion causes axial displacement of the cup and the screw relative to the barrel portion; and a flexible driveshaft extending between and rotationally fixed to the threaded screw and the cup, the flexible shaft extending across the pivoting joint disposed at the connection between the nose portion and the barrel portion.

8. The applicator of claim 7, wherein the pivoting joint is also a rotating joint.

9. The applicator of claim 8, wherein the rotating and pivoting joint comprises a ball-and-socket type joint.

10. The applicator of claim 7, wherein the barrel portion comprises a ball and the nose portion comprises a socket retaining at least a portion of the ball to form a rotating and pivoting joint.

11. The applicator of claim 10, wherein the ball comprises a through-bore and the flexible driveshaft extends through the through-bore.

12. The applicator of claim 11, wherein the through-bore includes a chamfered opening portion to facilitate bending of the flexible driveshaft.

13. The applicator of claim 7, further comprising a one-piece drive member comprising the threaded screw, the cup, and the flexible driveshaft.

14. The applicator of claim 7, further comprising a mass or instrument carried in the cup.

* * * * *